US012428249B2

(12) United States Patent
Oikawa et al.

(10) Patent No.: US 12,428,249 B2
(45) Date of Patent: Sep. 30, 2025

(54) SHEET FEEDING DEVICE AND IMAGE FORMING APPARATUS INCORPORATING THE SAME

(71) Applicants: Naoki Oikawa, Kanagawa (JP); Toshihiro Okutsu, Kanagawa (JP); Junya Suzuki, Kanagawa (JP)

(72) Inventors: Naoki Oikawa, Kanagawa (JP); Toshihiro Okutsu, Kanagawa (JP); Junya Suzuki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 43 days.

(21) Appl. No.: 18/596,704

(22) Filed: Mar. 6, 2024

(65) Prior Publication Data

US 2024/0300759 A1 Sep. 12, 2024

(30) Foreign Application Priority Data

Mar. 7, 2023 (JP) ..... 2023-034328

(51) Int. Cl.
*B65H 1/04* (2006.01)
*B65H 1/26* (2006.01)
(Continued)

(52) U.S. Cl.
CPC ..... *B65H 5/068* (2013.01); *B65H 1/266* (2013.01); *B65H 3/0669* (2013.01); *B65H 5/04* (2013.01); *B65H 2405/313* (2013.01)

(58) Field of Classification Search
CPC ..... B65H 5/068; B65H 1/266; B65H 3/0669; B65H 5/04; B65H 1/04
(Continued)

(56) References Cited

U.S. PATENT DOCUMENTS 9,731,918 B2 * 8/2017 Lee ..... B65H 1/12
2010/0133739 A1 * 6/2010 Shiraishi ..... B65H 3/5215 271/10.11
(Continued)

FOREIGN PATENT DOCUMENTS

JP 10-147451 A 6/1998
JP 2012-000908 A 1/2012
JP 2013-10593 * 1/2013

OTHER PUBLICATIONS

Machine translation of JP 2013-10593. (Year: 2013).*

*Primary Examiner* — Thomas A Morrison
(74) *Attorney, Agent, or Firm* — XSENSUS LLP

(57) ABSTRACT

A sheet feeding device includes a sheet feed tray, a conveying roller pair, and a contact-and-separation mechanism. The sheet feed tray is detachably attached to a body of an image forming apparatus. The conveying roller pair is disposed in the body of the image forming apparatus, conveys a sheet fed from the sheet feed tray attached to the body of the image forming apparatus, and includes a driving roller and a driven roller. The driving roller is rotated by a drive mechanism. The driven roller is rotated by the driving roller. The contact-and-separation mechanism separates the driven roller from the driving roller in conjunction with detachment of the sheet feed tray from the body of the image forming apparatus and brings the driven roller into contact with the driving roller by the drive mechanism when the sheet feed tray is detached from the body of the image forming apparatus.

9 Claims, 5 Drawing Sheets

(51) Int. Cl.
*B65H 3/06* (2006.01)
*B65H 5/04* (2006.01)
*B65H 5/06* (2006.01)

(58) Field of Classification Search
USPC ..... 271/272–274, 314
See application file for complete search history.

(56) References Cited

U.S. PATENT DOCUMENTS

| | | | | |
|---|---|---|---|---|
| 2012/0126475 | A1* | 5/2012 | Shin | B65H 1/266 271/226 |
| 2015/0028536 | A1* | 1/2015 | Takai | B65H 1/266 271/117 |
| 2015/0145199 | A1 | 5/2015 | Yoshida et al. | |

* cited by examiner

SHEET FEEDING DEVICE AND IMAGE FORMING APPARATUS INCORPORATING THE SAME

CROSS-REFERENCE TO RELATED APPLICATION

This patent application is based on and claims priority pursuant to 35 U.S.C. § 119(a) to Japanese Patent Application No. 2023-034328, filed on Mar. 7, 2023, in the Japan Patent Office, the entire disclosure of which is hereby incorporated by reference herein.

BACKGROUND

Technical Field

Embodiments of the present disclosure relate to a sheet feeding device that feeds a sheet such as a sheet of paper, and an image forming apparatus such as a copier, a printer, a facsimile machine, or a multi-functional peripheral or printer including at least two functions of a copier, a printer, and a facsimile machine.

Related Art

In image forming apparatuses such as copiers and printers, an image forming apparatus is widely known in which a sheet feed tray (sheet feed cassette) that stores sheets such as paper sheets is installed to be attachable to and detachable from (drawable from) a body of the image forming apparatus. The sheet fed from the sheet feed tray is further conveyed toward the downstream side in a conveyance direction by a conveying roller pair disposed adjacent to the downstream side in the conveyance direction.

SUMMARY

In an embodiment of the present disclosure, there is provided a sheet feeding device that includes a sheet feed tray, a conveying roller pair, and a contact-and-separation mechanism. The sheet feed tray is detachably attached to a body of an image forming apparatus and stores a sheet. The conveying roller pair is disposed in the body of the image forming apparatus, conveys the sheet fed from the sheet feed tray attached to the body of the image forming apparatus, and includes a driving roller and a driven roller. The driving roller is rotated by a drive mechanism. The driven roller contacts the driving roller and is rotated by the driving roller in conjunction with rotation of the driving roller. The contact-and-separation mechanism separates the driven roller from the driving roller in conjunction with detachment of the sheet feed tray from the body of the image forming apparatus and brings the driven roller into contact with the driving roller in conjunction with rotation of the driving roller by the drive mechanism when the sheet feed tray is detached from the body of the image forming apparatus.

In another embodiment of the present disclosure, there is provided an image forming apparatus that includes the sheet feeding device.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
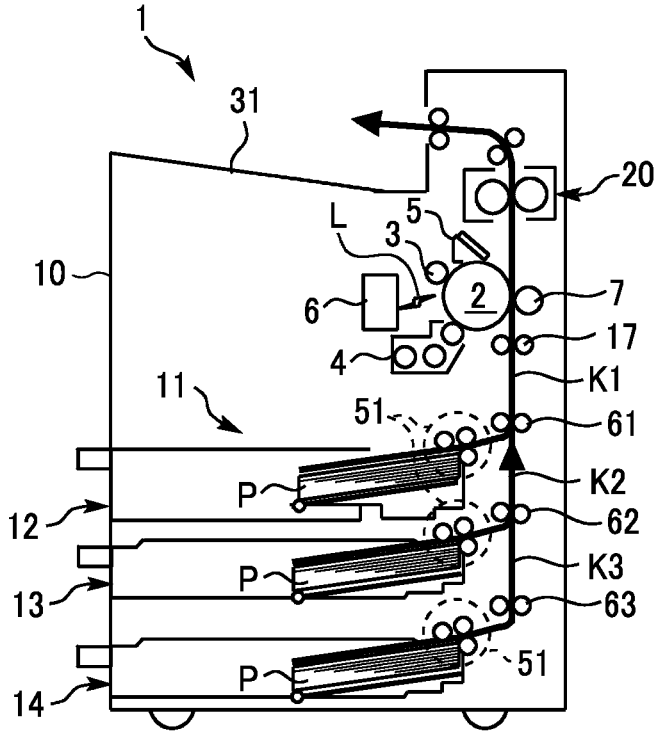
FIG. 1 is a schematic view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. In the drawings, like reference signs denote like elements, and overlapping description may be simplified or omitted as appropriate. As used herein, the singular forms "a," "an," and "the" are intended to include the plural forms as well, unless the context clearly indicates otherwise.

With reference to the drawings, embodiments of the present disclosure are described in detail below. In the drawings, like reference signs denote like elements, and overlapping description may be simplified or omitted as appropriate.

First, with reference to FIG. 1, a description is given of an overall configuration and operation of an image forming apparatus 1 according to an embodiment of the present disclosure. In FIG. 1, a printer as an image forming apparatus 1 includes a photoconductor drum 2, a charging device 3 that charges the surface of the photoconductor drum 2, and an exposure device 6 that irradiates the surface of the photoconductor drum 2 charged by the charging device 3 with laser light L to form an electrostatic latent image on the surface of the photoconductor drum 2. The image forming apparatus 1 also includes a developing device 4 that develops the electrostatic latent image formed on the surface of the photoconductor drum 2 to form a toner image and a transfer device 7 that transfers the toner image formed on the surface of the photoconductor drum 2 onto a sheet P. The image forming apparatus 1 also includes a cleaning device 5 that cleans untransferred toner remaining on the surface of the photoconductor drum 2. The image forming apparatus 1 also includes a sheet feeding device 11 provided with a first tray 12, a second tray 13, and a third tray 14 in three stages and a sheet feeding mechanism 51 for feeding the sheets P stored in the first tray 12, the second tray 13, and the third tray 14. The image forming apparatus 1 also includes a first conveying roller pair 61, a second conveying roller pair 62, and a third conveying roller pair 63 installed in a first conveyance path K1, a second conveyance path K2, and a third conveyance path K3, respectively. The image forming apparatus 1 also includes a registration roller pair 17 (timing roller pair) that conveys the sheet P toward the position of the transfer device 7, a fixing device 20 that fixes the toner image (unfixed image) borne on the sheet P, and a stacking portion 31 in which the sheets P ejected from a body 10 of the image forming apparatus 1 are stacked.

With reference to FIG. 1, a description is given of an operation of a normal image forming (printing) of the image forming apparatus 1. When image data is input to an exposure device 6 from a device such as a personal computer connected to the image forming apparatus 1, the exposure device 6 irradiates the photoconductor drum 2 with a laser beam L based on the image data.

On the other hand, the photoconductor drum 2 rotates counterclockwise in FIG. 1. After a series of specified image forming processes (e.g., a charging process, an exposing process, and a developing process) is completed, an image (toner image) corresponding to the image data is formed on the surface of the photoconductor drum 2. Thereafter, the toner image formed on the surface of the photoconductor drum 2 is transferred onto the sheet P conveyed by the registration roller pair 17 at the position of the transfer device 7 (image forming section).

On the other hand, a sheet P conveyed to the position of the transfer device 7 (image forming section) operates as follows. First, one of the first tray 12, the second tray 13, and the third tray 14 arranged in parallel below the image forming apparatus 1 is automatically or manually selected (e.g., the third tray 14 at the bottom is selected). An uppermost one of the sheets P stored in the third tray 14 is fed by the sheet feeding mechanism 51 and conveyed in the order of the third conveyance path K3 provided with the third conveying roller pair 63, the second conveyance path K2 provided with the second conveying roller pair 62, and the first conveyance path K1 provided with the first conveying roller pair 61. Thereafter, the sheet P reaches the position of the registration roller pair 17. When the sheet P reaches the registration roller pair 17, the rotation of the registration roller pair 17 is being stopped. As the leading end of the sheet P contacts the nip region formed by the rollers of the registration roller pair 17, the skew of the sheet P is corrected.

The registration roller pair 17 starts rotating again, and the sheet P is then conveyed toward the transfer device 7 (image forming section) in synchrony with the movement of the toner image formed on the surface of the photoconductor drum 2 so that the toner image is formed at the correct position on the sheet P. The transfer device 7 transfers the image on the photoconductor drum 2 onto the sheet P (a transfer process). The sheet P after the transfer process passes through the position of the transfer device 7 and then reaches the fixing device 20 through a conveyance path. In the fixing device 20, the uppermost sheet P is conveyed between a fixing roller and a pressure roller, so that the toner image is fixed to the sheet P by heat applied by a fixing roller, and pressure applied in the nip formed by the fixing roller and the pressure roller (a fixing process). After the sheet P on which the toner image is fixed in the fixing process is fed from the fixing device 20, the sheet P is ejected from the image forming apparatus 1 to be stacked on the stacking portion 31 as an output image. Thus, a series of the image forming processes (printing operation) is completed.

Figure 2:
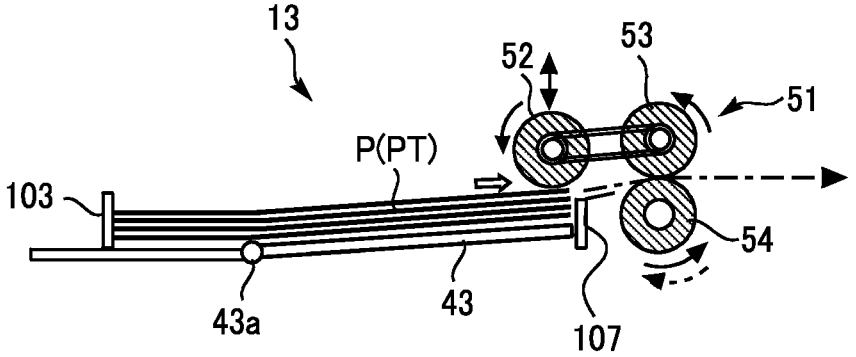
FIG. 2 is a view of a part of a sheet feeding device included in the image forming apparatus in FIG. 1, according to an embodiment of the present disclosure.

With reference to FIG. 2, a detail description is given below of the sheet feeding mechanism 51 in the sheet feeding device 11 according to the present embodiment. A description is given below of the sheet feeding mechanism 51 that feeds the sheet P stored in the second tray 13 in the middle stage among the first tray 12, the second tray 13, and the third tray 14. Since the sheet feeding mechanisms that feed the sheets P stored in the other trays, i.e., the first tray 12 and the third tray 14 have substantially the same configuration, descriptions thereof are omitted.

With reference to FIG. 2, the second tray 13 includes a sheet stacker 43 to stack a plurality of sheets P (a stack of sheets PT) and the sheet feeding mechanism 51 for feeding the sheets P stacked on the sheet stacker 43. The sheet stacker 43 is partly movable vertically (in the vertical direction) such that a downstream side (the right side in FIG. 2) in the sheet feed direction of the uppermost sheet P of the stack of sheets PT stacked on the sheet stacker 43 reaches a specified height position, which is a position where the uppermost sheet P contacts a pickup roller 52. Specifically, the sheet stacker 43 includes a lifting plate and a fixed plate. The lifting plate is rotatable around a rotation center shaft 43*a*. The fixed plate is a plate that does not vertically move. The lifting plate is disposed downstream from the fixed plate in the sheet feed direction and rotates around the rotation center shaft 43*a* in the forward and reverse directions. By so doing, the elevation plate moves in the vertical direction. With reference to FIG. 2, the sheet feeding mechanism 51 includes a sheet feed roller 53, the pickup roller 52, and a sheet separation roller 54.

The sheet feed roller 53 is disposed near the leading end (downstream end) of the sheets P stacked on the sheet stacker 43 in the sheet feed direction (in the direction indicated by white arrow in FIG. 2). The sheet feed roller 53 contacts the upper surface of the uppermost sheet P of the sheets P on the sheet stacker 43 and rotates (in the counterclockwise direction in FIG. 2) along the sheet feed direction, so that the sheet P is conveyed in the sheet feed direction indicated by the broken arrow in FIG. 2. The pickup roller 52 rotates counterclockwise in FIG. 2 along the sheet feed direction in contact with a front surface (upper surface) of the uppermost sheet P of the sheets stacked on the sheet stacker 43 to convey the uppermost sheet P toward the position of the sheet feed roller 53. The pickup roller 52 can contact and separate from the sheet P (uppermost sheet P) stacked on the sheet stacker 43 (lifting plate). In other words, the pickup roller 52 is movable between a retracted position at which the pickup roller 52 does not contact the sheet P stacked on the sheet stacker 43 and a contact position (the position indicated in FIG. 2) at which the pickup roller 52 contacts the sheet P as illustrated in FIG. 2. The sheet separation roller 54 is disposed to form a nip portion between the sheet separation roller 54 and the sheet feed roller 53. The sheet separation roller 54 rotates in a forward direction (the direction indicated by a dashed arrow in FIG. 2, and a clockwise direction) along the sheet feed direction when a single sheet P is nipped in the nip portion and when no sheet P is nipped in the nip portion. On the other hand, when a plurality of sheets P is nipped at the nip portion, the sheet separation roller 54 rotates in a reverse direction opposite to the forward direction described above (a direction indicated by a solid arrow in FIG. 2 and a counterclockwise direction). Thus, the uppermost sheet P of the sheets P nipped in the nip portion is fed in the sheet feed direction along the rotation of the sheet feed roller 53, and the lower sheet P is conveyed in a reverse direction opposite to the sheet feed direction (forward direction), so that the double feed and consecutive feed of the sheets P are reduced. In the present embodiment, a plate-shaped separation pad may be used instead of the sheet separation roller 54.

The sheet stacker 43 (lifting plate) moves up and down in the up-and-down direction according to the number of sheets P stacked on the sheet stacker 43 so that the pickup roller 52 can contact the uppermost sheet P in the stack of sheets PT stacked on the sheet stacker 43 (lifting plate). The sheet feeding operation of the sheets P starts after the pickup roller 52 is lowered to a position where the pickup roller 52 contacts the upper surface of the uppermost sheet P of the sheets P stacked on the sheet stacker 43 (lifting plate) whose position in the up-and-down direction has been adjusted. The second tray 13 according to the present embodiment is provided with a pair of side fences that restrict the positions of the sheets P stacked on the sheet stacker 43 in the width direction (the direction perpendicular to the plane on which FIG. 2 is illustrated). The side fences are disposed at both ends in the width direction to sandwich the sheet P and are movable in the width direction in conjunction with each other in accordance with the size of the sheet P in the width direction by a manual movement mechanism. In other words, the side fences can increase or decrease the interval in the width direction. The second tray 13 according to the present embodiment is provided with a reference fence 107 and an end fence 103. The reference fence 107 restricts the position in the sheet feed direction (the left-and-right direction in FIG. 2) of the sheet P stacked on the sheet stacker 43. The reference fence 107 is disposed such that the downstream end of the sheet P in the sheet feed direction (the leading end of the sheet P in the sheet feed direction) contacts the reference fence 107. The end fence 103 is disposed to contact the upstream end of the sheet P in the sheet conveyance direction (the trailing end of the sheet P in the sheet conveyance direction). The end fence 103 can be moved by the manual movement mechanism to conform to the size of the sheet P in the sheet conveyance direction.

A description is given below of the sheet feeding device 11 (image forming apparatus 1) in the present embodiment with reference to FIGS. 3A to 5. With reference to FIGS. 1, 3A, 3B, and 3C, the sheet feeding device 11 according to the present embodiment includes three (three-stage) trays, i.e., the first tray 12, the second tray 13, and the third tray 14 (sheet feed trays) that can store sheets P and are arranged in parallel in an up-and-down direction. Each one of the first tray 12, the second tray 13, and the third tray 14 is attachable to and detachable from (drawable from) the body 10 of the image forming apparatus 1. The sheet feeding mechanism 51 is disposed above the downstream side of each of the first tray 12, the second tray 13, and the third tray 14 in the sheet feed direction. The conveying roller pair 61, 62, or 63 (conveyance path K1, K2, or K3) is disposed further downstream from the sheet feeding mechanism 51 in the sheet feed direction. In the specification of the present application, the state in which the first tray 12, the second tray 13, or the third tray 14 (sheet feed trays) that is "attachable to and detachable from" the body 10 of the image forming apparatus 1 are "detached" is defined to include a state in which the first tray 12, the second tray 13, or the third tray 14 is not only completely detached from the body 10 of the image forming apparatus 1 but also a state in which the first tray 12, the second tray 13, or the third tray 14 is partially held by the body 10 of the image forming apparatus 1 and partially pulled out from the body 10 (e.g., a state like the first tray 12 illustrated in FIG. 3B).

With reference to FIGS. 3A to 5, the sheet feeding device 11 according to the present embodiment is provided with the first tray 12 as a sheet feed tray and the first conveying roller pair 61 as a conveying roller pair. The first tray 12 is detachably attached to the body 10 of the image forming apparatus and functions as a sheet feed tray that can store a sheet P (or a plurality of sheets P). The first conveying roller pair 61 is disposed in the body 10 of the image forming apparatus 1 so as not to be attached and detached in conjunction with the attachment and detachment operation of the first tray 12 (sheet feed tray), and functions as a conveying roller pair for conveying the sheet P fed from the first tray 12 (sheet feed tray) attached to the body 10 of the image forming apparatus 1. The first conveying roller pair 61 (conveying roller pair) includes a driving roller 61*a* and a driven roller 61*b*, and forms a nip therebetween to nip and convey the sheet P. The driving roller 61*a* is rotated by a drive mechanism 90 (see FIGS. 4A, 4B, 4C, and 5). The driven roller 61*b* contacts the driving roller 61*a* and is driven to rotate in conjunction with the rotation of the driving roller 61*a*.

The second conveying roller pair 62 and the third conveying roller pair 63 are also disposed in the body 10 of the image forming apparatus 1 so as not to be attached and detached in conjunction with the attachment and detachment operation of the second tray 13 and the third tray 14, respectively, and convey the sheet P fed from the second tray 13 and the third tray 14 attached to the body 10 of the image forming apparatus 1.

As described above with reference to FIG. 3A, the sheet feeding device 11 is provided with at least one second feed tray different from the first tray 12 (sheet feed tray). Specifically, in the present embodiment, when the first tray 12 functions as a sheet feed tray (first sheet feed tray), two second sheet feed trays (the second tray 13 and the third tray 14) are disposed. The first conveying roller pair 61 (conveying roller pair) is disposed in the conveyance path of the sheet P fed from the second sheet feed trays (the second tray 13 and the third tray 14). Specifically, when the sheet P is fed from the second tray 13, the sheet P passes through the second conveyance path K2 (second conveying roller pair 62) and the first conveyance path K1 (first conveying roller pair 61). When the sheet P is fed from the third tray 14, the sheet P passes through the third conveyance path K3 (third conveying roller pair 63), the second conveyance path K2 (second conveying roller pair 62), and the first conveyance path K1 (first conveying roller pair 61). Such a relation between the "sheet feed tray (first sheet feed tray)" and the "second sheet feed tray" applies in the relation between an upper tray (on the downstream side in the conveyance direction) and any lower tray (on the upstream side in the conveyance direction), and also applies in the relation between the second tray 13 and the third tray 14. For this reason, a description of the relation between the second tray 13 and the third tray 14 is omitted, and only the relation between the first tray 12 and each of the second tray 13 and the third tray 14 is described below.

Figure 3A:
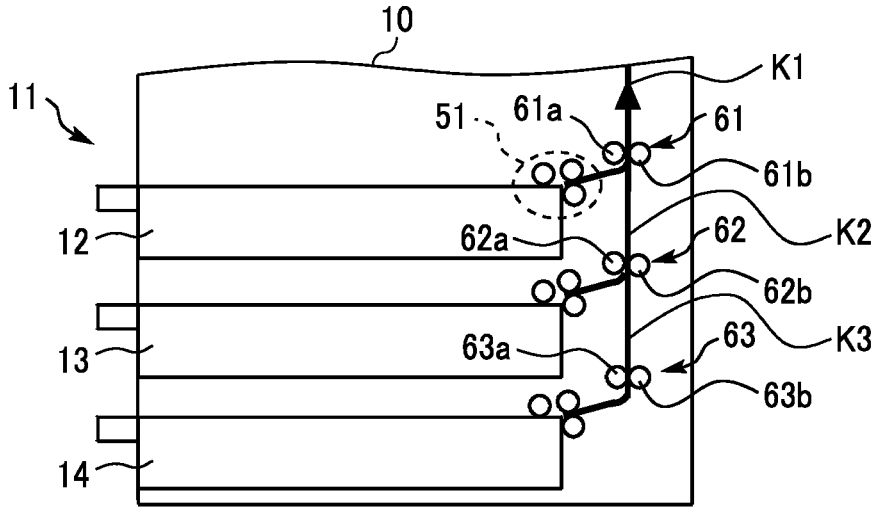
FIGS. 3A to 3C are diagrams illustrating a series of an operation in which, after a first tray is pulled out of a body of the image forming apparatus of FIG. 1, feeding by a second tray or a third tray is performed, according to an embodiment of the present disclosure.
Figure 3B:
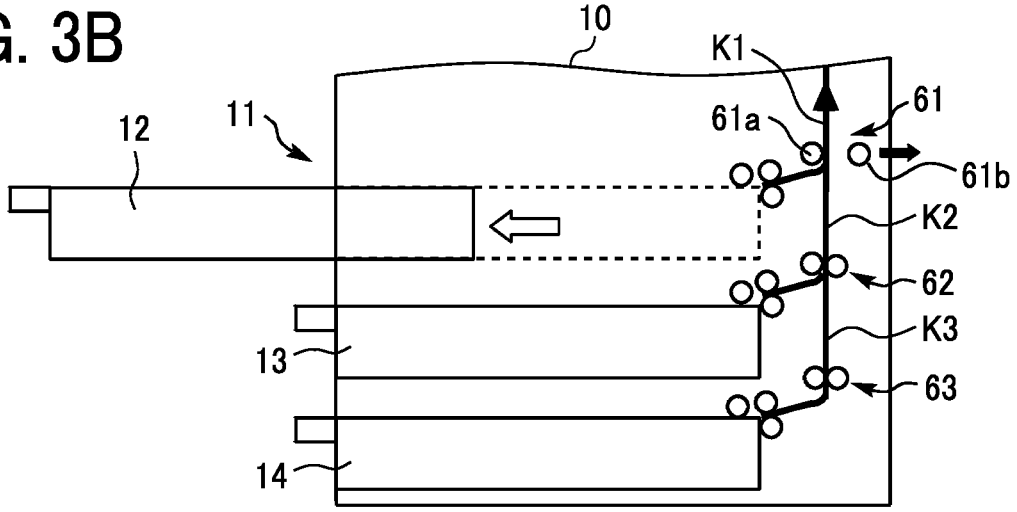
Figure 3C:
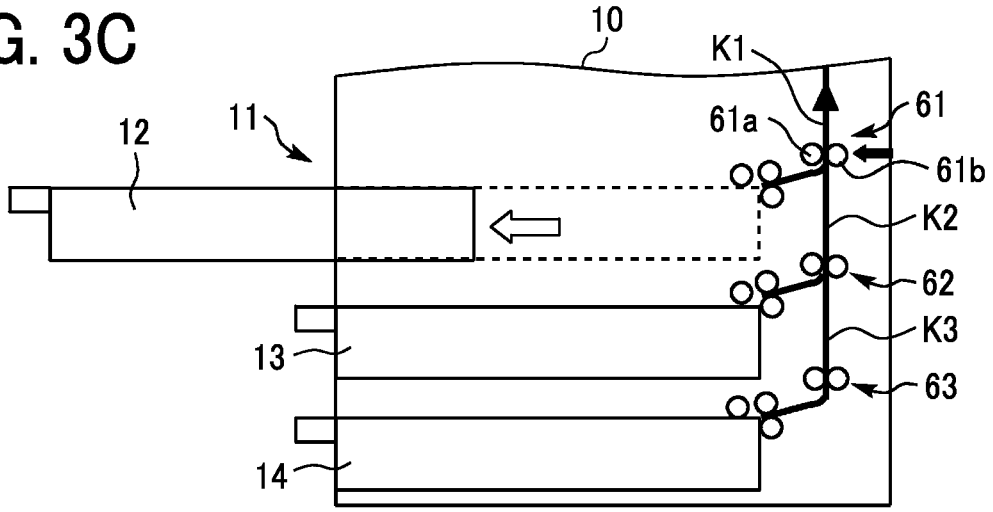
Figure 4A:
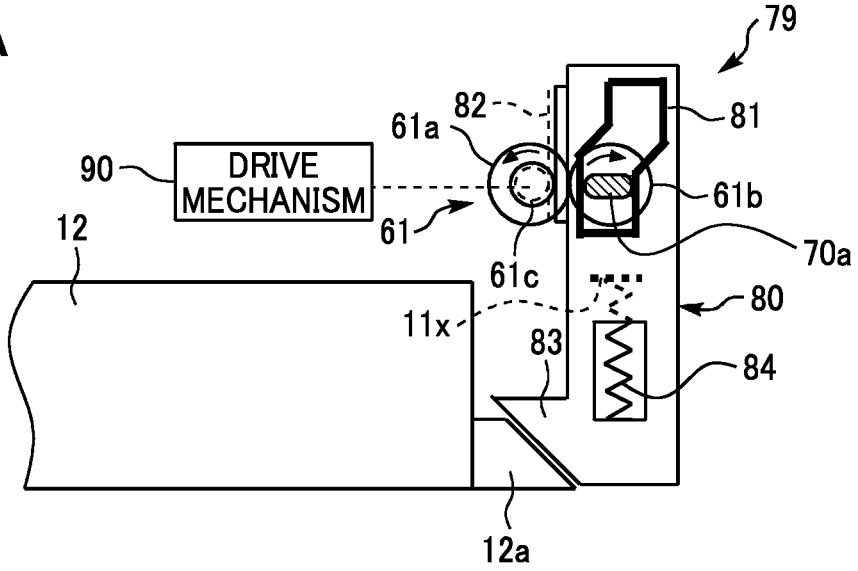
FIGS. 4A to 4C are diagrams illustrating a configuration and a series of an operation of a contact-and-separation mechanism, according to an embodiment of the present disclosure.
Figure 4B:
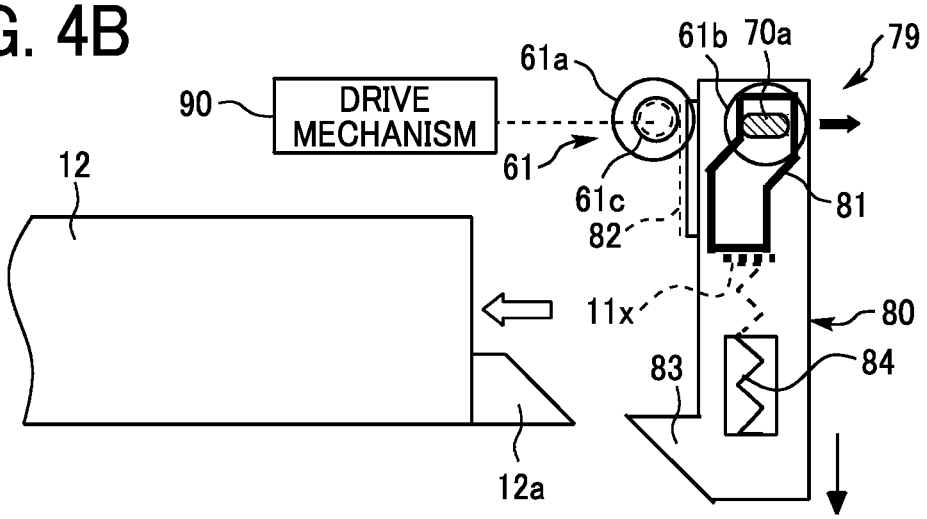
Figure 4C:
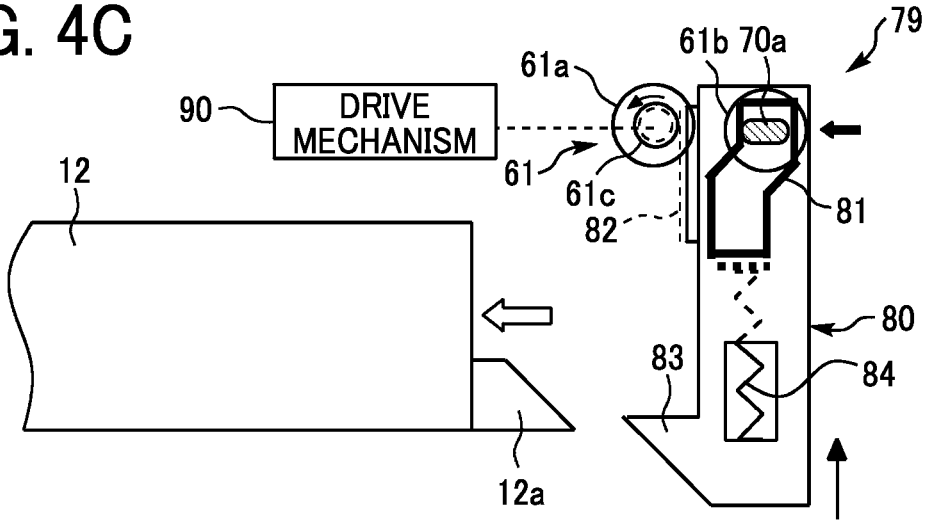

With reference to FIGS. 4A, 4B, and 4C (and FIGS. 3A, 3B, and 3C), the sheet feeding device 11 according to the present embodiment is provided with a contact-and-separation mechanism 79 that contacts and separates the driving roller 61*a* and the driven roller 61*b* of the first conveying roller pair 61 as a conveying roller pair. The contact-and-separation mechanism 79 separates the driven roller 61*b* from the driving roller 61*a* in conjunction with an operation of separating (drawing) the first tray 12 (sheet feed tray) from the body 10 of the image forming apparatus 1. Specifically, as illustrated in FIGS. 3A and 4A, when the first tray 12 is attached to the body 10 of the image forming apparatus 1 as in normal printing, the driving roller 61*a* and the driven roller 61*b* are in contact with each other, and the sheet P can be conveyed by the first conveying roller pair 61. Accordingly, the sheet P can be fed not only from the first tray 12 but also from the second tray 13 and the third tray 14 in the lower stages. As illustrated in FIGS. 3B and 4B, when the first tray 12 is pulled out of the body 10 of the image forming apparatus 1 in a state where printing is stopped (in a state where the driving of the image forming apparatus 1 (the driving roller 61*a*) is stopped), the driven roller 61*b* is separated from the driving roller 61*a* by the contact-and-separation mechanism 79. The driving roller 61*a* and the driven roller 61*b* are thus separated from each other, so that even when the sheet P is jammed at the position (nip) of the first conveying roller pair 61, the jammed sheet P can be easily taken out (removed) by inserting a hand into the space from which the first tray 12 has been pulled out. In the states of FIGS. 3B and 4B, the conveyance of the sheet P by the first conveying roller pair 61 is unlikely to be performed as it is, and thus the feeding of the sheet P from the second tray 13 and the third tray 14 in the lower stages is also unlikely to be performed.

In the state where the first tray 12 (sheet feed tray) is detached, the contact-and-separation mechanism 79 according to the present embodiment brings the driven roller 61*b* into contact with the driving roller 61*a* in conjunction with the rotation of the driving roller 61*a* driven by the drive mechanism 90. Specifically, as illustrated in FIG. 4C, when the driving of the driving roller 61*a* by the drive mechanism 90 is started from a state where the driven roller 61*b* is separated from the driving roller 61*a* as illustrated in FIGS. 3B and 4B, the driven roller 61*b* is switched from the separation state to the contact state with respect to the driving roller 61*a* as illustrated in FIG. 3C. Accordingly, as illustrated in FIG. 3C, even in the state where the first tray 12 is pulled out, the feeding of the sheet P from the second tray 13 and the third tray 14 on the lower stages (sheet conveyance using the first conveying roller pair 61) can be performed.

As described above, the sheet feeding device 11 according to the present embodiment includes the contact-and-separation mechanism 79 that switches the driven roller 61*b* from the separation state to the contact state with respect to the driving roller 61*a* in conjunction with an operation in which the driving roller 61*a* is rotated in the state where the first tray 12 (sheet feed tray) is detached. Thus, the sheet P can be conveyed by the first conveying roller pair 61 (conveying roller pair) while the first tray 12 (sheet feed tray) is left detached from the body 10 of the image forming apparatus 1. When the feeding of the sheet P from the second tray 13 or the third tray 14 in the lower stage (sheet conveyance using the first conveying roller pair 61) is performed in the state where the first tray 12 is pulled out as illustrated in FIG. 3C, a user gives a print instruction to a controller of the image forming apparatus 1 via, for example, a personal computer to perform printing by feeding the sheet P from the second tray 13 or the third tray 14. In response to such a print instruction, the drive mechanism 90 is driven to rotate the driving roller 61*a*, and thus the driven roller 61*b* is switched from the separation state (the state illustrated in FIG. 3B) to the contact state (the state illustrated in FIG. 3C). In such a case, a mechanical operation time is required until the driven roller 61*b* is switched from the separation state to the contact state. Thus, the sheet feeding from the second tray 13 or the third tray 14 is started after such a mechanical time has elapsed.

Figure 5:
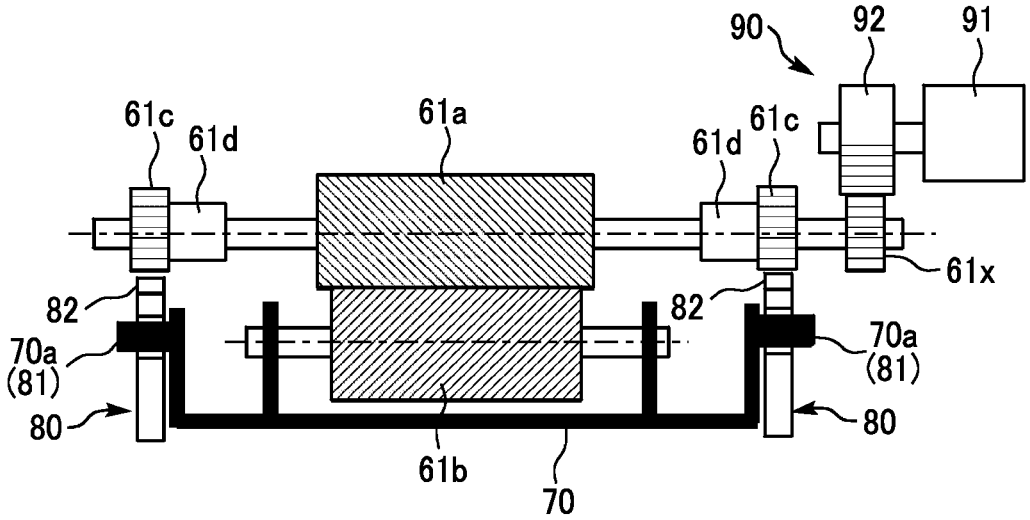
FIG. 5 is a view of a conveying roller pair, a drive mechanism, and the contact-and-separation mechanism of FIGS. 4A to 4C in an axial direction.

A description is given below of a configuration and operation of the contact-and-separation mechanism 79 in detail with reference to FIGS. 4A, 4B, 4C, and 5. With reference to FIGS. 4A, 4B, 4C, and 5, the contact-and-separation mechanism 79 according to the present embodiment includes pinion gears 61*c*, torque limiters 61*d*, movable members 80 (movable plates), and compression springs 84 as biasing members. The pinion gears 61*c* are disposed at both ends of a rotation shaft of the driving roller 61*a* to be rotatable with the driving roller 61*a*. As illustrated in FIG. 5, a driving gear 61*x* is disposed at one end of the rotation shaft of the driving roller 61*a*. The driving gear 61*x* meshes with a motor gear 92 disposed on a motor shaft of a driving motor 91, and the drive of the driving motor 91 is transmitted to the driving gear 61*x*. Accordingly, the driving motor 91, which is controlled by the controller, rotates the driving roller 61*a* in a specified direction (counterclockwise in FIG. 4). With such a configuration, for example, the driving motor 91 and the motor gear 92 function as the drive mechanism 90 that rotates the driving roller 61*a*.

With reference to FIGS. 4A, 4B, 4C, and 5, the movable members 80 are disposed at both ends of the sheet feeding device 11 in the axial direction (both ends in the width direction). The movable member 80 is provided with a link 81 and a rack gear 82. The movable member 80 is held by a housing formed in the sheet feeding device 11 to be movable in an up-and-down direction. On the other hand, rotation shafts at both ends of the driven roller 61*b* are rotatably supported by a holder 70. Fitting portions 70*a* that protrude outward in the axial direction are formed at both ends of the holder 70 in the axial direction.

The link 81 of the movable member 80 is an irregularly shaped opening portion formed on the plate-shaped movable member 80, and moves in a specified direction (direction indicated by the downward arrow in FIG. 4B) in conjunction with the operation of detaching (operation of pulling out) the first tray 12 (sheet feed tray) to move the driven roller 61*b* in the separating direction (direction indicated by the black rightward arrow in FIG. 4B). Specifically, the link 81 is provided with an opening extending vertically in a rectangular shape at a lower portion close to the driving roller 61*a*, an opening extending vertically in a rectangular shape at an upper portion far from the driving roller 61*a*, and an opening that relays the openings at a center portion between the upper portion and the lower portion. The fitting portion 70*a* of the holder 70 that holds the driven roller 61*b* fits with the link 81. With such a configuration, when the movable member 80 moves downward from the position of FIG. 4A to the position of FIG. 4B, the fitting portion 70*a* moves rightward along the shape of the link 81, and the driven roller 61*b* also moves rightward along with the movement of the fitting portion 70*a*. As a result, the driven roller 61*b* is separated from the driving roller 61*a*. On the other hand, when the movable member 80 moves upward from the position of FIG. 4B (or FIG. 4C) to the position of FIG. 4A, the fitting portion 70*a* moves leftward along the shape of the link 81, and the driven roller 61*b* also moves leftward along with the movement of the fitting portion 70*a*. As a result, the driven roller 61*b* contacts the driving roller 61*a*.

The rack gear 82 of the movable member 80 is disposed to mesh with the pinion gear 61*c* of the driving roller 61*a*.

With such a configuration, with reference to FIG. 4C, when the pinion gear 61*c* meshing with the rack gear 82 rotates counterclockwise in conjunction with the rotation of the driving roller 61*a* driven by the drive mechanism 90, the movable member 80 moves upward (in the direction indicated by the upward arrow in FIG. 4C) such that the link 81 moves leftward (in the direction opposite the specified direction described above). Thus, the driven roller 61*b* contacts the driving roller 61*a*. In a state where the driven roller 61*b* of the first conveying roller pair 61 contacts the driving roller 61*a* as such, the printing by sheet feeding (sheet conveyance) from the second tray 13 and third tray 14 can be performed.

With reference to FIGS. 4A, 4B, and 4C, the compression spring 84 (biasing member) of the contact-and-separation mechanism 79 biases the movable member 80 such that the link 81 moves in a specified direction (rightward in FIGS. 4A, 4B, and 4C). Specifically, one end (upper end) of the compression spring 84 is coupled to a housing 11*x* of the sheet feeding device 11, and the other end (lower end) is coupled to a lower end of an opening of the movable member 80. A biasing force of the compression spring 84 is useful when the movable member 80 is lowered (when the driven roller 61*b* is separated) and when the weight of the movable member 80 alone cannot naturally rotate the driving roller 61*a* (pinion gear 61*c*) in the reverse direction due to the load resistance of the drive mechanism 90.

As illustrated in FIG. 4A, the first tray 12 (sheet feed tray) is provided with a contacted portion 12*a* that contacts a contact portion 83 of the movable member 80 while the first tray 12 is attached to the image forming apparatus 1. The contacted portion 12*a* restricts the movement of the movable member 80 against the biasing of the compression spring 84 (biasing member) such that the link 81 does not move in a specified direction (rightward in FIGS. 4A, 4B, and 4C). In other words, when the contacted portion 12*a* of the first tray 12 is in contact with the contact portion 83 of the movable member 80, the movable member 80 is pushed upward against a spring force of the compression spring 84. As illustrated in FIG. 4B, when the first tray 12 is pulled out, the contact between the contacted portion 12*a* and the contact portion 83 is released, and then, the movable member 80 is lowered by the spring force of the compression spring 84 and its own weight of the movable member 80 to separate the driven roller 61*b*. Each of the contacted portion 12*a* and the contact portion 83 is formed so that an opposite surface facing a counterpart is inclined with respect to the attachment-and-detachment direction in order to smoothly contact and separate from each other.

With reference to FIG. 5, the pinion gear 61*c* according to the present embodiment is disposed on the rotation shaft of the driving roller 61*a* via the torque limiter 61*d*. The pinion gear 61*c* idles relative to the rotation shaft when the driving torque applied to the rotation shaft of the driving roller 61*a* reaches a specified value. With such a configuration, as illustrated in FIG. 4C, even if the movable member 80 contacts the housing (a stopper portion) of the sheet feeding device 11 when the driving roller 61*a* (pinion gear 61*c*) is rotated by the drive mechanism 90 to move the movable member 80 upward, the driving roller 61*a* rotates while the pinion gear 61*c* idles due to an increase of the driving torque. Thus, printing can be performed while the first conveying roller pair 61 is rotated in the state of FIG. 3C.

In the present embodiment, the contact-and-separation mechanism 79 may prevent the driven roller 61*b* from separating from the driving roller 61*a* when the first tray 12 (sheet feed tray) is detached from the body 10 of the image forming apparatus 1 in the state where the driving roller 61*a* is driven by the drive mechanism 90. Specifically, even if the first tray 12 is pulled out during a printing operation in which sheets P are fed from the second tray 13 and the third tray 14 in the lower stages, as illustrated in FIG. 3C, the first conveying roller pair 61 is not separated, and the printing operation is not interrupted in that state. Such a configuration is achieved as it is using the contact-and-separation mechanism 79 described with reference to FIGS. 4A, 4B, and 4C. Such a configuration can further enhance the user's convenience for the image forming apparatus 1.

As described above, the relations between the "sheet feed tray (first sheet feed tray)" and the "second sheet feed tray" described so far is applied in the relation between the upper tray (on the downstream side in the conveyance direction) and any lower tray (on the upstream side in the conveyance direction). For this reason, in the relation between the second tray 13 and the third tray 14, the above-described characteristic configuration related to the first tray 12 and the first conveying roller pair 61 described above can also be applied to the second tray 13 and the second conveying roller pair 62. In the present embodiment, the third tray 14 is the lowermost tray and no tray is installed below the third tray 14. However, for example, in a case where there is a possibility that another tray is optionally added to a further lower stage, the above-described characteristic configuration related to the first tray 12 and the first conveying roller pair 61 is also preferably applied to the third tray 14 and the third conveying roller pair 63.

Modification

Figure 6A:
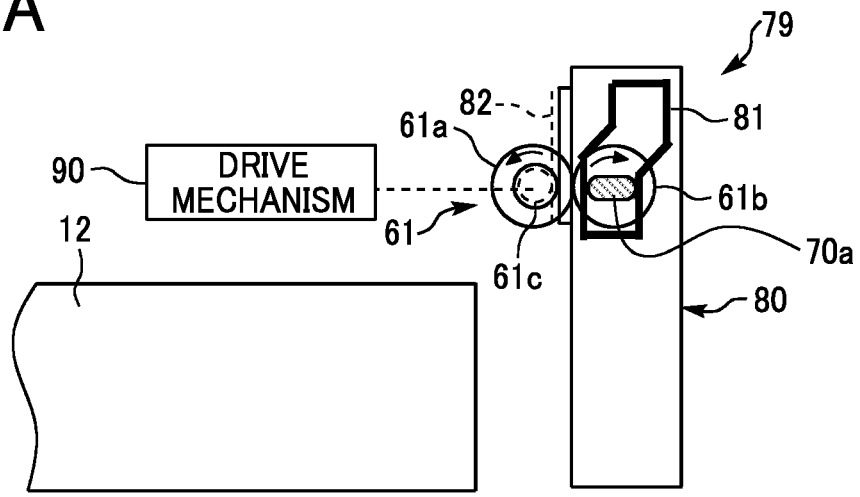
FIGS. 6A to 6C are diagrams illustrating a configuration and an operation of a contact-and-separation mechanism as a modification of the embodiment illustrated in FIGS. 4A to 4C.
Figure 6B:
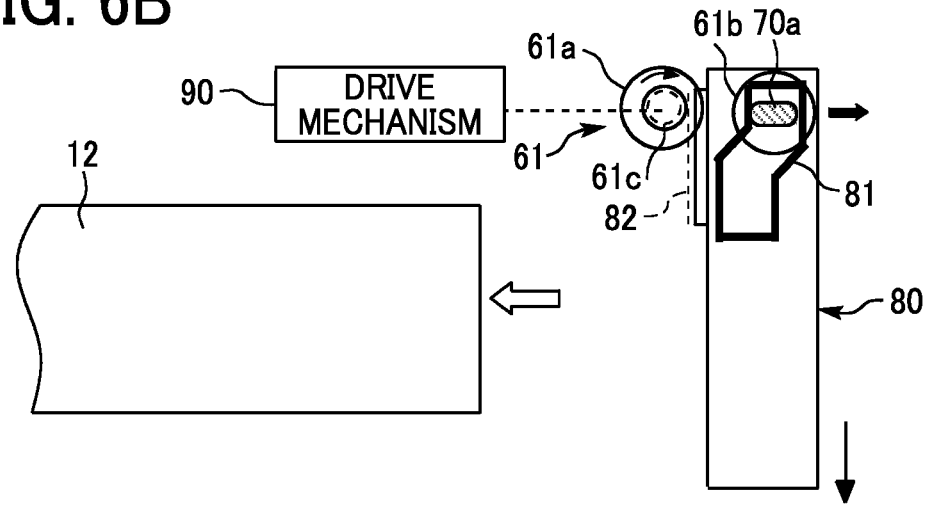
Figure 6C:
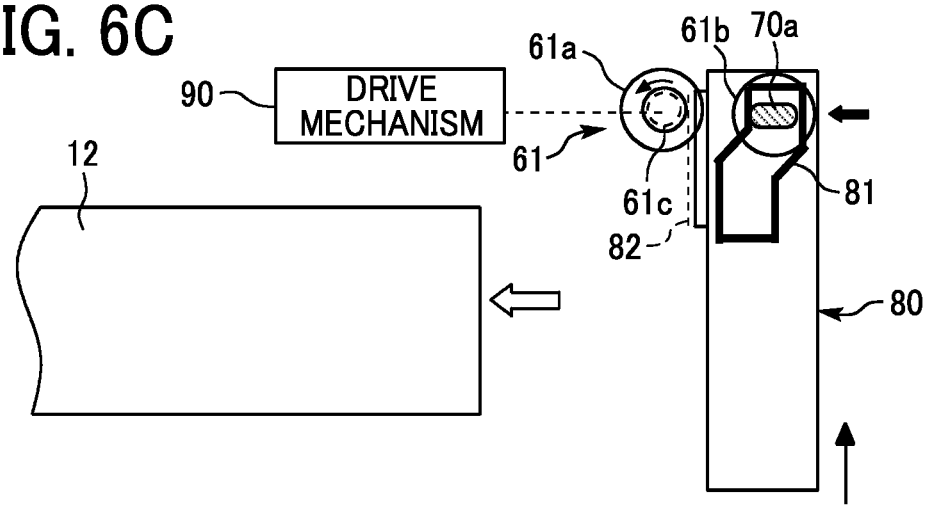

As illustrated in FIGS. 6A, 6B, and 6C, a contact-and-separation mechanism 79 according to a modification of the above embodiments of the present disclosure rotates the driving roller 61*a* in reverse in conjunction with an operation of detaching a first tray 12 (sheet feed tray) from a body 10 of an image forming apparatus 1. Specifically, the driving motor 91 (see FIG. 5) of the drive mechanism 90 that rotates the driving roller 61*a* (pinion gear 61*c*) is a motor that can rotate in forward and reverse directions and can rotate the driving roller 61*a* (pinion gear 61*c*) in a reverse direction relative to a direction of rotation in printing (sheet conveyance). The contact-and-separation mechanism 79 according to the modification is not provided with the compression spring 84 and the contact portion 83 as illustrated in FIGS. 4A, 4B, and 4C, and the first tray 12 is also not provided with the contacted portion 12*a*. As illustrated in FIG. 6B, when the first tray 12 is pulled out, the drive mechanism 90 (the driving motor 91) is controlled to rotate the driving roller 61*a* (the pinion gear 61*c*) in the reverse direction to switch the driven roller 61*b* from the contact state to the separation state. Even in a case of such a configuration, the sheet P can be conveyed by the first conveying roller pair 61 (conveying roller pair) while the first tray 12 (sheet feed tray) is left detached from the body 10 of the image forming apparatus 1.

As described above, in the sheet feeding device 11 according to the present embodiment, the first tray 12 (sheet feed tray) that can store the sheet P is detachably attached to the body 10 of the image forming apparatus 1. The first conveying roller pair 61 (conveying roller pair) that conveys the sheet P fed from the first tray 12 attached to the image forming apparatus 1 is installed in the body 10 of the image forming apparatus 1. The first conveying roller pair 61 is provided with the driving roller 61*a* that is rotated by the drive mechanism 90, and the driven roller 61*b* that contacts the driving roller 61*a* and is driven in conjunction with the rotation of the driving roller 61*a*. The contact-and-separation mechanism 79 is disposed so that the contact-and-separation mechanism 79 separates the driven roller 61*b* from the driving roller 61*a* in conjunction with an operation in which the first tray 12 is detached from the body 10 of the image forming apparatus 1, and brings the driven roller 61*b* into contact with the driving roller 61*a* in conjunction with an operation in which the driving roller 61*a* is rotated by the drive mechanism 90 in a state in which the first tray 12 is detached from the body of the image forming apparatus 1. As a result, the sheet P can be conveyed by the first conveying roller pair 61 (conveying roller pair) while the first tray 12 (sheet feed tray) is left detached from the body 10 of the image forming apparatus 1.

The above-described embodiments of the present disclosure are applied to the sheet feeding device 11 provided for the image forming apparatus 1 that is a monochrome image forming apparatus. However, for example, the present disclosure is also applicable to a sheet feeding device provided for a color image forming apparatus. The above-described embodiments of the present disclosure are applied to the sheet feeding device 11 provided for the image forming apparatus 1 that employs electrophotography. However, the present disclosure is not limited to the above-described sheet feeding device (that is, the sheet feeding device 11). For example, the present disclosure is also applicable to a sheet feeding device provided for an image forming apparatus that employs an inkjet method or a stencil printing machine. In the above-described embodiments, the first tray 12, the second tray 13, and the third tray 14 in three stages are disposed in the image forming apparatus 1. One, two, or four or more stages of trays (including a manual sheet feed tray exposed to the outside of the image forming apparatus) may also be disposed in the image forming apparatus. As described above, the present disclosure can be applied to one tray or each of a plurality of trays. The above-described embodiments of the present disclosure are applied to the sheet feeding device 11 provided with the sheet feeding mechanism 11 including the pickup roller 52, the sheet feed roller 53, and the sheet separation roller 54. However, for example, the present disclosure is naturally applicable to sheet feeding devices provided with other types of feeding mechanisms. Such cases can attain advantageous effects equivalent to the above-described effects of the above-described embodiments.

The above-described embodiments and modifications are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited to the embodiments and thus may be preferably set to be applied to the present disclosure.

In the present description, the term "sheet" is defined as any sheet-like recording medium, such as general paper, coated paper, label paper, overhead projector (OHP) transparency, or a film sheet.

Aspects of the present disclosure may be, for example, combinations of first to ninth aspects as follows.

First Aspect

A sheet feeding device (e.g., the sheet feeding device 11) includes a sheet feed tray (e.g., the first tray 12), a conveying roller pair (e.g., the first conveying roller pair 61), and a contact-and-separation mechanism (e.g., the contact-and-separation mechanism 79). The sheet feed tray is detachably attached to a body (e.g., the body 10) of an image forming apparatus (e.g., the image forming apparatus 1) and is capable of storing a sheet (e.g., the sheet P). The conveying roller pair is disposed in the body of the image forming apparatus and conveys the sheet fed from the sheet feed tray attached to the body of the image forming apparatus. The conveying roller pair includes a driving roller (e.g., the driving roller 61*a*) and a driven roller (e.g., the driven roller 61*b*). The driving roller is rotated by a drive mechanism (e.g., the drive mechanism 90). The driven roller contacts the driving roller and is rotated by the driving roller in conjunction with rotation of the driving roller. The contact-and-separation mechanism separates the driven roller from the driving roller in conjunction with detachment of the sheet feed tray from the body of the image forming apparatus and brings the driven roller into contact with the driving roller in conjunction with rotation of the driving roller by the drive mechanism when the sheet feed tray is detached from the body of the image forming apparatus.

Second Aspect

The sheet feeding device (e.g., the sheet feeding device 11) according to the first aspect further includes at least one second sheet feed tray (e.g., the second tray 13, or the third tray 14) different from the sheet feed tray (e.g., the first tray 12). The conveying roller pair (e.g., the first conveying roller pair 61) is disposed in a conveyance path (e.g., the second conveyance path K2) of the sheet (e.g., the sheet P) fed from the second sheet feed tray.

Third Aspect

In the sheet feeding device (e.g., the sheet feeding device 11) according to the first or second aspect, the driving roller (e.g., the driving roller 61*a*) is provided with a pinion gear (e.g., the pinion gear 61*c*) that is rotatable together with the driving roller. The contact-and-separation mechanism (e.g., the contact-and-separation mechanism 79) includes a movable member (e.g., the movable member 80). The movable member includes a link (e.g., the link 81) and a rack gear (e.g., the rack gear 82). The link moves in a specified direction in conjunction with the detachment of the sheet feed tray (e.g., the first tray 12) to move the driven roller (e.g., the driven roller 61*b*) in a direction of separation from the driving roller. The rack gear meshes with the pinion gear. When the pinion gear that meshes with the rack gear rotates in conjunction with the rotation of the driving roller by the drive mechanism (e.g., the drive mechanism 90), the movable member moves such that the link moves in a direction opposite to the specified direction and the driven roller contacts the driving roller.

Fourth Aspect

In the sheet feeding device (e.g., the sheet feeding device 11) according to the third aspect, the contact-and-separation mechanism (e.g., the contact-and-separation mechanism 79) includes a biasing member (e.g., the compression spring 84) that biases the movable member (e.g., the movable member 80) such that the link (e.g., the link 81) moves in the specified direction.

Fifth Aspect

In the sheet feeding device (e.g., the sheet feeding device 11) according to the fourth aspect, the sheet feed tray (e.g., the first tray 12) includes a contacted portion (e.g., the contacted portion 12*a*) to contact a contact portion (e.g., the contact portion 83) of the movable member (e.g., the movable member 80) in a state where the sheet feed tray is attached to the body (e.g., the body 10) of the image forming apparatus (e.g., the image forming apparatus 1) and restricts movement of the link (e.g., the link 81) of the movable member in the specified direction against biasing of the biasing member (e.g., the compression spring 84).

Sixth Aspect

In the sheet feeding device (e.g., the sheet feeding device 11) according to the third aspect, the drive mechanism (e.g., the drive mechanism 90) rotates the driving roller (e.g., the driving roller 61*a*) in a reverse direction in conjunction with the detachment of the sheet feed tray (e.g., the first tray 12).

Seventh Aspect

In the sheet feeding device (e.g., the sheet feeding device 11) according to any one of the first to sixth aspects, the pinion gear (e.g., the pinion gear 61*c*) is mounted on a rotation shaft via a torque limiter (e.g., the torque limiter 61*d*), and idles relative to the rotation shaft when driving torque applied to the rotation shaft reaches a specified value.

Eighth Aspect

In the sheet feeding device (e.g., the sheet feeding device 11) according to any one of the first to seventh aspects, the contact-and-separation mechanism (e.g., the contact-and-separation mechanism 79) prevents the driven roller (e.g., the driven roller 61*b*) from separating from the driving roller (e.g., the driving roller 61*a*), when the sheet feed tray (e.g., the first tray 12) is detached from the body (e.g., the body 10) of the image forming apparatus (e.g., the image forming apparatus 1) while the driving roller is driven by the drive mechanism (e.g., the drive mechanism 90).

Ninth Aspect

An image forming apparatus (e.g., the image forming apparatus 1) includes the sheet feeding device (e.g., the sheet feeding device 11) according to any one of the first to eighth aspects.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. A sheet feeding device comprising:

a sheet feed tray detachably attached to a body of an image forming apparatus, the sheet feed tray to store a sheet;

a conveying roller pair disposed in the body of the image forming apparatus, the conveying roller pair to convey the sheet fed from the sheet feed tray attached to the body of the image forming apparatus, the conveying roller pair includes:

a driving roller to be rotated by a drive mechanism; and a driven roller to contact the driving roller and be rotated by the driving roller in conjunction with rotation of the driving roller; and a contact-and-separation mechanism to:

separate the driven roller from the driving roller in conjunction with detachment of the sheet feed tray from the body of the image forming apparatus; and bring the driven roller into contact with the driving roller in conjunction with rotation of the driving roller by the drive mechanism when the sheet feed tray is detached from the body of the image forming apparatus.

2. The sheet feeding device according to claim 1, further comprising at least another sheet feed tray different from the sheet feed tray, wherein the conveying roller pair is disposed in a conveyance path of the sheet fed from the at least another sheet feed tray.

3. The sheet feeding device according to claim 1, wherein the driving roller is provided with a pinion gear that is rotatable together with the driving roller, wherein the contact-and-separation mechanism includes a movable member, the movable member includes:

a link to move in a specified direction in conjunction with the detachment of the sheet feed tray to move the driven roller in a direction of separation from the driving roller; and a rack gear meshing with the pinion gear, and wherein when the pinion gear meshing with the rack gear rotates in conjunction with the rotation of the driving roller by the drive mechanism, the movable member moves such that the link moves in a direction opposite to the specified direction, and the driven roller contacts the driving roller.

4. The sheet feeding device according to claim 3, wherein the contact-and-separation mechanism includes a biasing member that biases the movable member such that the link moves in the specified direction.

5. The sheet feeding device according to claim 4, wherein the sheet feed tray includes a contacted portion to contact a contact portion of the movable member when the sheet feed tray is attached to the body of the image forming apparatus, and restrict movement of the link of the movable member in the specified direction against biasing of the biasing member.

6. The sheet feeding device according to claim 3, wherein the drive mechanism rotates the driving roller in a reverse direction in conjunction with the detachment of the sheet feed tray.

7. The sheet feeding device according to claim 3, wherein the pinion gear is mounted on a rotation shaft via a torque limiter, and idles relative to the rotation shaft when driving torque applied to the rotation shaft reaches a specified value.

8. The sheet feeding device according to claim 1, wherein the contact-and-separation mechanism prevents the driven roller from separating from the driving roller, when the sheet feed tray is detached from the body of the image forming apparatus while the driving roller is driven by the drive mechanism.

9. An image forming apparatus comprising the sheet feeding device according to claim 1.

* * * * *